US007461432B2

(12) United States Patent
Löwen et al.

(10) Patent No.: US 7,461,432 B2
(45) Date of Patent: Dec. 9, 2008

(54) DOOR HINGE WITH ARRESTER FOR MOTOR VEHICLE DOORS

(75) Inventors: Jakob Löwen, Gummersbach (DE); Viktor Siegert, Reichshof-Eckenhagen (DE); Gerhard Reuber, Drolshagen (DE)

(73) Assignee: ISE Innomotive Systems Europe GmbH (DE)

( * ) Notice: Subject to any disclaimer, the term of this patent is extended or adjusted under 35 U.S.C. 154(b) by 69 days.

(21) Appl. No.: 10/572,881

(22) PCT Filed: Sep. 13, 2004

(86) PCT No.: PCT/EP2004/010205

§ 371 (c)(1),
(2), (4) Date: Mar. 20, 2006

(87) PCT Pub. No.: WO2005/033454

PCT Pub. Date: Apr. 14, 2005

(65) Prior Publication Data

US 2007/0050940 A1 Mar. 8, 2007

(30) Foreign Application Priority Data

Sep. 18, 2003 (DE) ..... 103 43 587

(51) Int. Cl.
*E05D 11/10* (2006.01)

(52) U.S. Cl. ..... 16/334; 16/342

(58) Field of Classification Search ..... 16/286, 16/287, 288, 366, 370, 334, 374, 328, 331, 16/332, 284; 296/146.11, 146.12
See application file for complete search history.

(56) References Cited

U.S. PATENT DOCUMENTS 5,409,297 A * 4/1995 De Filippo ..... 297/411.32
5,765,263 A 6/1998 Bolinas et al.

(Continued)

FOREIGN PATENT DOCUMENTS

DE GM 1992 913 8/1968

(Continued)

*Primary Examiner*—Chuck Y. Mah
(74) *Attorney, Agent, or Firm*—Bachman & LaPointe, P.C.

(57) ABSTRACT

The invention relates to a door hinge with a holder for motor vehicle doors, wherein the door hinge comprises a pillar bracket attachable at a motor vehicle and a door bracket connectable with the motor vehicle door, said door bracket being connected with said pillar bracket via a hinge pin arranged at one bracket in an anti-rotational manner and rotatably arranged in the other bracket, said holder comprising a stop member carrier connected in an anti-rotational manner with the hinge pin and an engagement element supported so as to be rotatable together with the other bracket relative to said stop member carrier, said engagement element having at least one stop mark on a surface facing the stop member carrier, wherein at least one stop member biased by a spring element is arranged on the stop member carrier in such a way that it can be brought into engagement with the surface of the engagement element facing the stop member carrier. In order to provide a door hinge wherein the spring force acting on the stop members is essentially the same in all opening positions, the holder comprises at least two spring biased stop members, wherein the spring element presses at its ends on two neighboring or opposite stop members arranged on the stop member carrier.

11 Claims, 11 Drawing Sheets

U.S. PATENT DOCUMENTS

| | | | | |
|---|---|---|---|---|
| 6,012,201 | A * | 1/2000 | Mitts et al. | 16/334 |
| 6,029,314 | A * | 2/2000 | Kluting et al. | 16/334 |
| 6,481,056 | B1 * | 11/2002 | Jesse | 16/334 |
| 6,532,627 | B2 * | 3/2003 | Audisio | 16/334 |
| 6,851,159 | B1 * | 2/2005 | Nikolic et al. | 16/335 |
| 2003/0093873 | A1 * | 5/2003 | Linnenbrink | 16/85 |
| 2004/0187260 | A1 * | 9/2004 | Bruckner et al. | 16/334 |

FOREIGN PATENT DOCUMENTS

| | | | |
|---|---|---|---|
| DE | 86 21 214.1 | | 1/1988 |
| DE | 40 36 910 A 1 | | 5/1991 |
| DE | 43 00 134 134 | A1 | 7/1993 |
| DE | 196 26 704 A 1 | | 1/1998 |
| DE | 197 28 641 A 1 | | 1/1998 |
| DE | 196 33 462 A 1 | | 2/1998 |
| DE | 19626928 | A1 * | 2/1998 |
| DE | 200 15 850 | U1 | 2/2002 |
| FR | 1.203.451 | | 1/1960 |
| FR | 1.250.349 | | 3/1960 |
| FR | 2 495 212 | | 4/1982 |
| FR | 2660008 | A1 * | 9/1991 |
| FR | 2 781 516 | | 1/2000 |
| WO | WO 9015728 | A1 * | 12/1990 |

* cited by examiner

DOOR HINGE WITH ARRESTER FOR MOTOR VEHICLE DOORS

BACKGROUND OF THE INVENTION

The present invention relates to a door hinge with a holder for motor vehicle doors, wherein the door hinge comprises a pillar bracket attachable to a motor vehicle and a door bracket connectable to the motor vehicle door. This door bracket is pivotably linked to the pillar bracket via a hinge pin held in one bracket in an anti-rotational manner and rotatably arranged in the other bracket, and the holder comprises a stop member carrier connected to the hinge pin in an anti-rotational manner and an engagement element arranged rotatable with the other bracket relative to the stop member carrier, at which engagement element at least one stop mark is arranged on a surface facing the stop member carrier, wherein at least one stop member biased by a spring element is arranged on the stop member carrier in such a way that it can be brought into engagement with the surface of the engagement element facing the stop member carrier.

Such a door hinge is known for example from DE 196 33 462 A1. With the door hinge described therein, the holder comprises stop members configured as breaking and holding members, biased by a spring, which on the one hand contacts the breaking and holding members and on the other hand presses against the hinge pin. The spring causes the breaking and holding members to engage in recesses forming stop marks of a holding apparatus that correspond to predetermined opening positions of a motor vehicle door and thus to hold the door in each position.

Such a door hinge has a drawback, however, in that due to the use of separate spring elements for each of the individual breaking and holding members resulting from the different stress profiles of the individual springs and the metal fatigue associated with it, the springs have different spring forces even after a short lifespan. This in turn has the consequence that a motor vehicle door attached to the door hinge is held in the individual angular positions associated with each stop mark with hugely differing holding forces. In the extreme, this could cause individual angular positions to be held only with a small spring force or none at all, whereas other angular positions are held with extremely high spring forces.

SUMMARY OF THE INVENTION

It is therefore an object of the present invention to provide a door hinge wherein the spring force acting on the stop member is essentially the same in all opening positions.

The object is solved according to the present invention by a door hinge as described herein. Advantageous embodiments of the present invention are also defined herein.

Depending on the structural preconditions, the hinge pin carrying the holder can be arranged in an anti-rotational manner either on the pillar bracket or on the door bracket, wherein the engagement unit rotatable relative to the stop member carrier or to the hinge pin, respectively, is connected in an anti-rotational manner to the bracket that is opposite the bracket serving to receive the hinge pin in an anti-rotational manner. The characterizing feature of the door hinge according to the present invention is a holder comprising at least two spring biased stop members, wherein the spring element is supported at its end on two neighboring or opposite stop members arranged on the stop member carrier.

The support of the end of the spring element against the stop members of the holder makes it possible to eliminate the otherwise necessary configuration of the other structural elements of the holder or the door hinge to support the spring element. The simultaneous spring biasing of the stop members by a single spring element also allows a reduction of the number of springs used when compared with the number of springs necessary for individually supporting each stop member, thus enabling the door hinge to have a compact and simple structure, which facilitates low-cost manufacture.

The simultaneous support also ensures that the two stop members engaging one spring element are always biased with the same spring force, so that in each corresponding opening position the door hinge gives the user the impression that the actuating force for moving the door out of the stop mark is always uniform.

In principle the arrangement of the spring elements on the holder can be done in any suitable way. The spring elements can thus be distributed, for example, around the hinge pin, wherein each of the springs biases two neighboring stop members.

When four stop members, uniformly distributed, for example, around the stop member carrier, and two spring elements are used, these can be arranged parallel to each other and in a tangential relationship to the hinge pin axis. As the case may be, two additional spring elements may also be used, which are aligned in an identical way to each other and at right angles to the spring elements already present, and which additionally apply a spring force to the stop members.

According to an advantageous embodiment of the present invention, the spring element extends between two stop members opposite each other through corresponding bores in the hinge pin. This embodiment of the invention has the advantage that the resulting spring force is vertical to the hinge pin so that an optimal transmission of the spring force to the stop member and the associated stop marks is ensured. Also in this embodiment, the entire spring force is applied essentially at right angles to the stop mark and therefore a precisely predetermined force for holding the door in a predetermined position is applied.

According to another advantageous embodiment of the present invention, the stop members are biased by at least one other spring element essentially extending in parallel to the first spring element. The use of a second spring element ensures higher operational safety of the door hinge. The engagement force can also be further increased or the spring force of the individual spring elements can be reduced. Moreover, a possible jamming of the stop members in the holder is prevented in a particularly reliable manner.

Principally any member may be used as a stop member, which when arranged in a correspondingly formed stop mark provides a resistive moment against rotation, while moving out of the stop mark when a correspondingly high moment is applied. According to an advantageous embodiment of the present invention, however, balls or cylindrical pins, circular in diameter, are provided, which can be brought into engagement with at least one inside surface having a stop mark formed in a way corresponding to the balls or pins, of the engagement element configured as an engagement sleeve.

The use of balls or pins of circular diameter ensures that the stop members may be moved with uniform force in the area adjacent to the stop marks on the inside surface of the engagement sleeve, since the pins and the balls are able to roll on the corresponding surfaces. When pins are used according to this embodiment of the present invention, the surfaces engaging each other in the case of engagement, i.e. the sides of the stop marks and the surface of the stop members, can be enlarged in a particularly simple manner, so that the desired stopping moment is achieved even with a small spring force. As necessary, the stopping moment can also be adjusted to be correspondingly high.

When an engagement sleeve according to the present embodiment is used, it is arranged coaxially with the hinge pin so that the stop members are pressed by the spring elements in a radial direction away from the hinge pin and against the inside surface of the engagement sleeve. The use of an engagement sleeve enables the holder and therefore a corresponding door hinge to be manufactured with particularly small dimensions. Especially when pins are used as the stop members, the present embodiment of the invention allows the holder to be assembled in a particularly simple manner. For this purpose, the pins only need to be pushed back in a radial direction toward the hinge pin until the engagement sleeve is partially axially slipped onto the stop member carrier, and can subsequently be released.

In principle, the distribution of the stop marks on the inside surface of the engagement sleeve can be arranged in any suitable way, wherein they are adapted to the angular positions of the door in which the door is to be held. According to an advantageous embodiment of the present invention, however, stop members opposite to each other are essentially engageable synchronously with stop marks arranged in a corresponding way opposite to each other on the inside surface of the engagement sleeve. According to this embodiment of the invention, the stop members belonging to one pair and biased by the same spring at their ends, simultaneously engage corresponding stop marks. As a consequence of the simultaneous engagement of the stop members in corresponding stop marks, the spring force can be reduced while the force necessary for engagement can be maintained, or the engagement force can be increased while the same spring elements are used, since the contact surface relevant for engagement is formed by two stop members.

According to another alternative embodiment of the invention, the stop marks are distributed on the inside surface of the engagement sleeve in such a way that the stop members opposite each other are alternately engageable with the associated stop marks. This embodiment of the invention allows the number of stop members and the number of stop marks to be reduced while the number of stop positions remains equal. This embodiment thus allows a door hinge to be provided with the required characteristics while a reduced number of structural elements is used, so that the manufacturing costs of the door hinge can be further reduced.

As an alternative to the above-described exemplary embodiments, in which the stop members can be synchronously or singly brought into engagement with corresponding stop marks, it is also possible to arrange the stop marks on the engagement sleeve in such a manner that in individual angular positions two or more stop members, and in other angular positions, only one stop member comes into engagement with one or more corresponding stop marks. This allows different holding forces to be adjusted for each different angular position of the door, if indeed this is necessary or desired.

According to another embodiment of the invention, the stop member carrier has grooves suitably configured for guiding the stop members and corresponding bores for guiding the spring elements. These grooves and bores additionally increase the functional safety of the door hinge by ensuring that both the stop members and the spring elements remain in their respective positions. Also, a possible jamming of the stop members is effectively avoided.

The type of spring element and the number of stop members can be freely chosen in principle. According to an advantageous embodiment of the invention, however, one or two pairs of opposing stop members are provided. Each of these pairs are biased by two spring elements contacting the stop members at each end and extending through corresponding bores in the stop member carrier and formed by spiral springs.

Spiral springs have the advantage that they are particularly cheap and reliable. The use of one or more pairs of opposing stop members, depending on the number of desired stop positions and on the strength of the spring elements, makes it possible to configure the holder in a corresponding way. By using one or two pairs of opposing stop members which are particularly easy to arrange on the holder, it is also possible to reduce the manufacturing costs of the door hinge in a particular way.

In principle, the anti-rotation connection between the hinge pin and the stop member carrier can be done in any desired way. According to an advantageous embodiment of the invention, however, the hinge pin has at least one protrusion in the area of its contacting surface with the stop member carrier. This protrusion can be brought into engagement with a correspondingly formed groove on the stop member carrier. This embodiment of the invention makes it possible in a particularly simple manner, to implement a releasable and at the same time anti-rotational connection between the hinge pin and the stop member carrier. Depending on the number of protrusions used and the associated grooves, the functional safety can be additionally increased.

According to an alternative embodiment of the invention, the hinge pin can, however, be integrally formed with the stop member carrier, which makes it possible to further reduce the number of components of the door hinge and the manufacturing and assembly costs.

In principle the choice of materials for the elements involved in the engagement action, can be made according to the structural preconditions resulting from the mechanical stresses. According to a particularly advantageous embodiment of the invention, the stop members, the engagement element and/or the stop member carrier are hardened, preferably surface hardened, in their contact areas.

Which components are hardened will depend on the requirements placed on the door hinge. Since, due to the hardening, the wear and tear of the particularly stressed components can be reduced, the reliability and the lifespan of the door hinge can also be increased, however.

In addition to through hardening, surface hardening of the components in their contact areas is particularly advantageous, since it can be carried out with little manufacturing overhead. Apart from the traditional hardening techniques using heat treatment, the hardening techniques that can be used for this purpose are laser hardening or surface hardening by the application of a hard material coating (e.g. by PVD or CVD techniques).

During surface hardening, the stop members are usually surface hardened over their entire surface. When the stop member carrier and the engagement element configured, for example, as an engagement sleeve are surface hardened, the surface hardening can be limited to the area contacting the stop member in order to additionally lower the manufacturing cost.

BRIEF DESCRIPTION OF THE DRAWINGS

Exemplary embodiments of the invention will be explained in detail in the following with reference to the drawings, in which.

DETAILED DESCRIPTION

Figure 1:
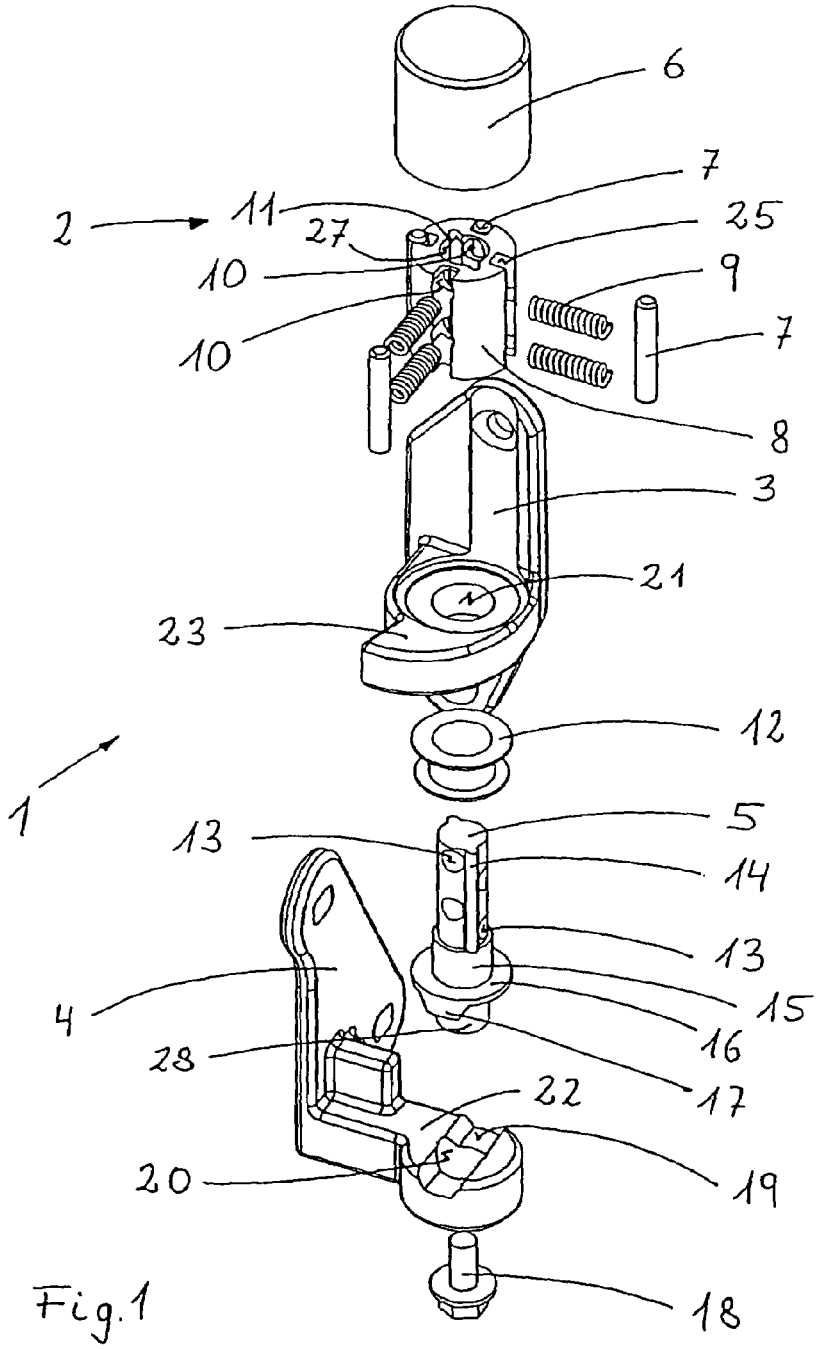
FIG. 1 is an exploded view of a first embodiment of a door hinge with a holder with four stop members and a hinge pin which can be attached in an anti-rotational manner on the pillar brackets by means of a protrusion.

In the view of FIG. 1 of door hinge 1, the individual parts of door hinge 1 are shown as separated from each other, whereby, however, their relative positions to the main axis has been maintained.

Door hinge 1 comprises a pillar bracket 4 to be attached to a frame of a vehicle (not shown), on which pillar bracket 4 a door bracket 3 to be attached to a motor vehicle door (not shown) is rotatably supported via a hinge pin 5.

Figure 2:
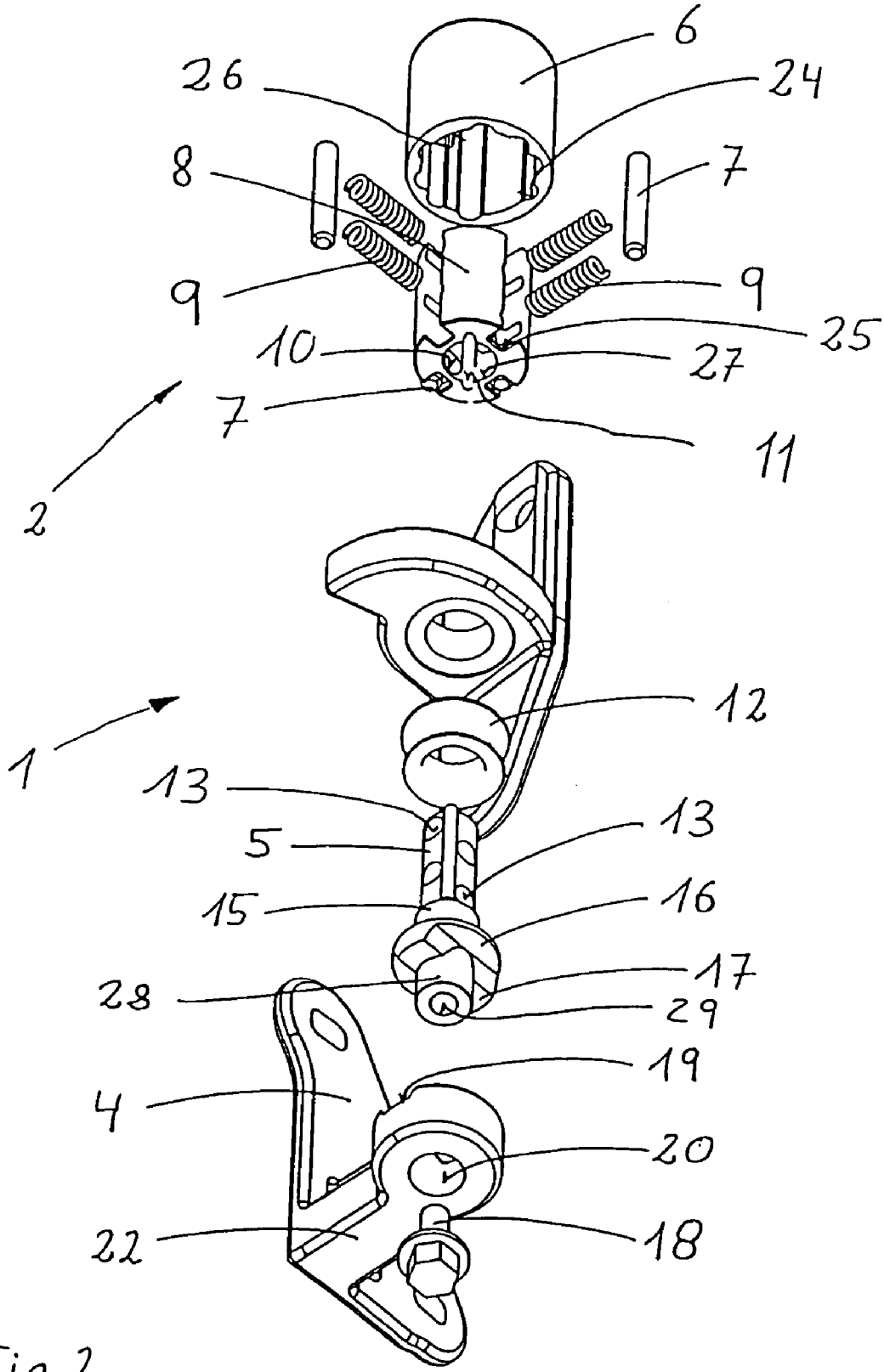
FIG. 2 is another exploded view of the door hinge in FIG. 1.

Hinge pin 5 comprises, in the area of its end, which faces a leg 22 of pillar bracket 4, a connection section 28 and a step 16 adjacent to it which, on the side facing leg 22, has a protrusion 17. For the anti-rotation support of hinge pin 5 on pillar bracket 4, leg 22 has a recess 19 formed to correspond to protrusion 17 and an opening 20 to receive the connection section 28. In its assembled condition of the present door hinge 1, hinge pin 5 is held in recess 19 by a screw 18 insertable through a threaded bore 29 from a side of leg 22 in connection section 28 opposite hinge pin 5 (cf. FIG. 2).

For the rotatable arrangement of door bracket 3 on hinge pin 5, the latter has a sliding section 15 arranged, in its assembled state, in the area of a through hole 21 of door bracket 3 arranged on a leg 23 of door bracket 3, wherein a bearing bush 12 is arranged in through hole 21.

A holder 2 comprises a stop member carrier 8 essentially circular in diameter, with grooves 25 arranged at angular intervals of 90° on the circumferential surface. Grooves 25 are for the reception of pins 7 spring biased by spiral springs 9 contacting at their ends opposite pins 7 and radially spring biasing them in a direction away from hinge pin 5. Spiral springs 9 are arranged in corresponding bores 10, 13 in stop member carrier 8 and hinge pin 5.

In the assembled state, hinge pin 5 is arranged in a anti-rotational relationship via protrusions 14 laterally protruding from hinge pin 5. Protrusions 14 extend in a circular opening 27 of stop member carrier 8. Bores 13 in hinge pin 5 and bores 10 in stop member carrier 8 are aligned with each other in the assembled state.

In the assembled state, engagement sleeve 6 is coaxial with stop member carrier 8 with pins 7 arranged on it. Stop marks 24, which are formed at corresponding opening positions of the motor vehicle door (not shown) in a corresponding relationship to pins 7, are arranged on an inside surface 28 of engagement sleeve 6.

The anti-rotation connection of door bracket 3 and the outer surface of engagement sleeve 6 can be achieved in any desired manner, such as by positive, frictional and/or material engagement. In the present embodiment, engagement sleeve 6 is glued to door bracket 3.

Figure 3:
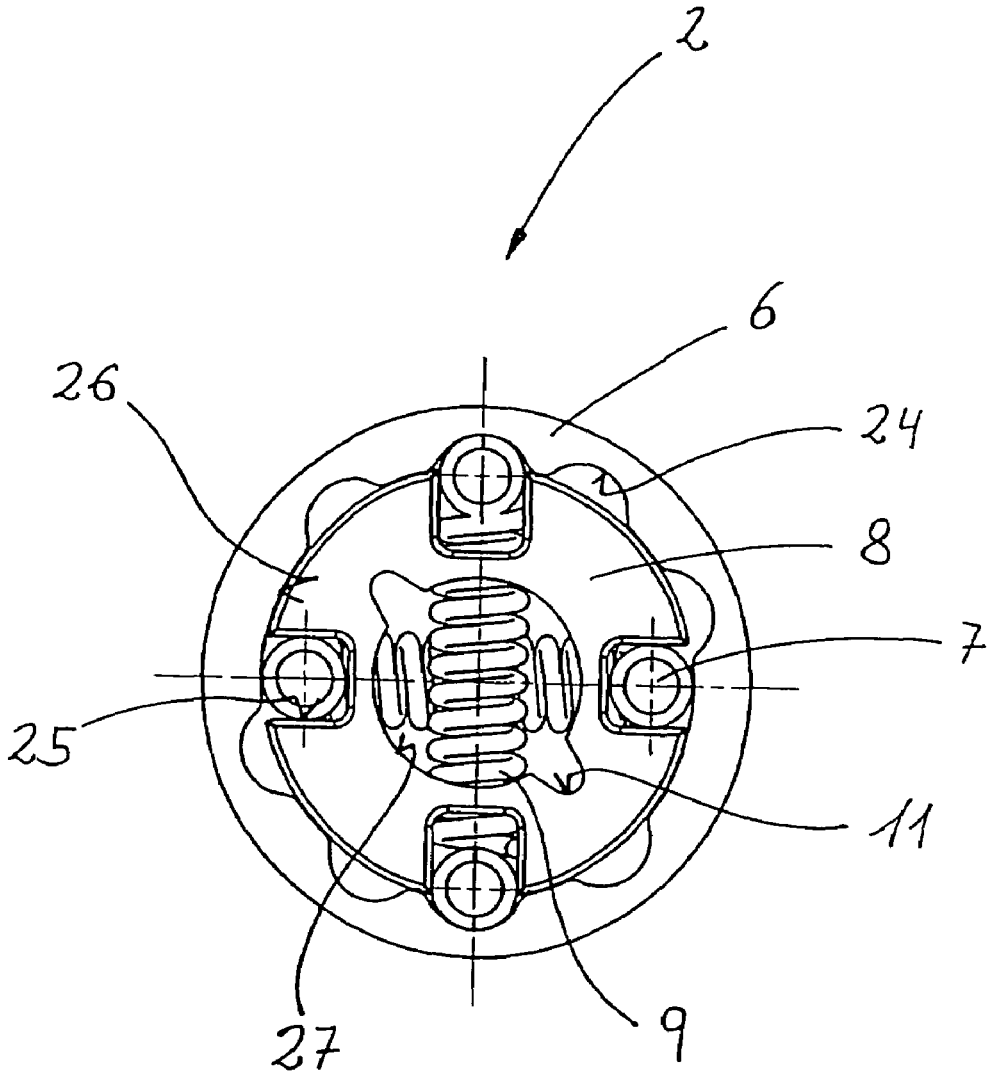
FIG. 3 is a sectional view of the holder of the door hinge in FIG. 1.

In an angular position, in which the motor vehicle door (not shown) is not held, pins 7 are fully inserted in grooves 25 and biased by spiral springs 9. When a corresponding angular position is reached, pins 7 are pressed by spiral springs 9 to partially leave grooves 25 and enter into stop marks 24, by which means the respective angular position (cf. FIG. 3) is held.

In the present exemplary embodiment, holder 2 has an overall number of four pins 7, each biased in opposing pairs by two spiral springs 9, wherein spiral springs 9 are offset by 90° from each other in the stop member carrier 8 and hinge pin 5.

Figure 4:
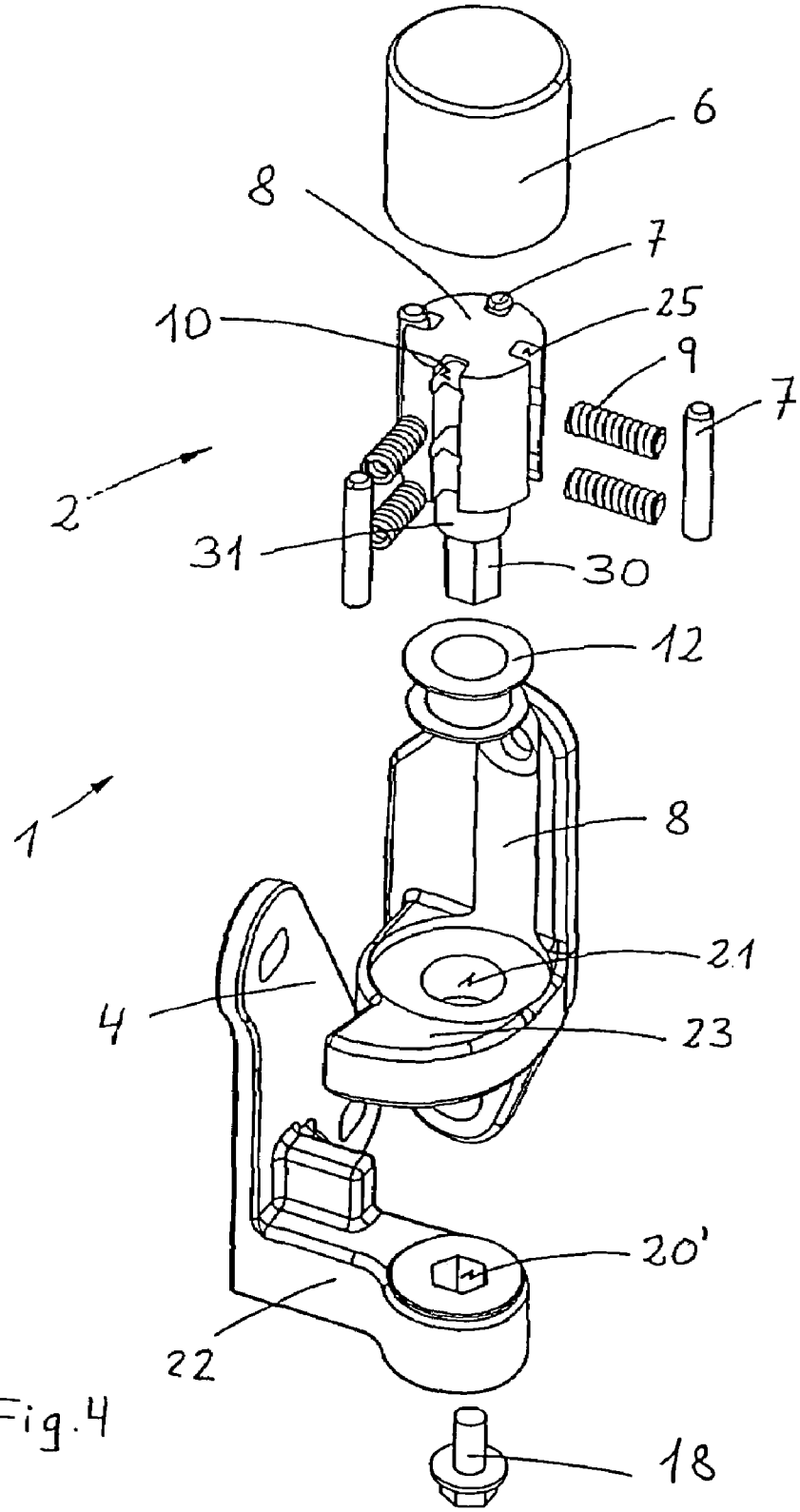
FIG. 4 shows another embodiment of a door hinge with a hinge pin configured as a stop member carrier and four stop members arranged on it.

In another embodiment of door hinge 1' shown in FIG. 4, stop member carrier 8 is integrally formed with hinge pin 5 and has a shank 31 so that it can be rotatably supported in bearing bush 12 arranged in through bore 21. For an anti-rotation arrangement of stop member carrier 8 at door bracket 4, the latter has a hexagonal connection section 30 which can be arranged in a corresponding receiving opening 20' in leg 22 of door bracket 4.

Figure 5:
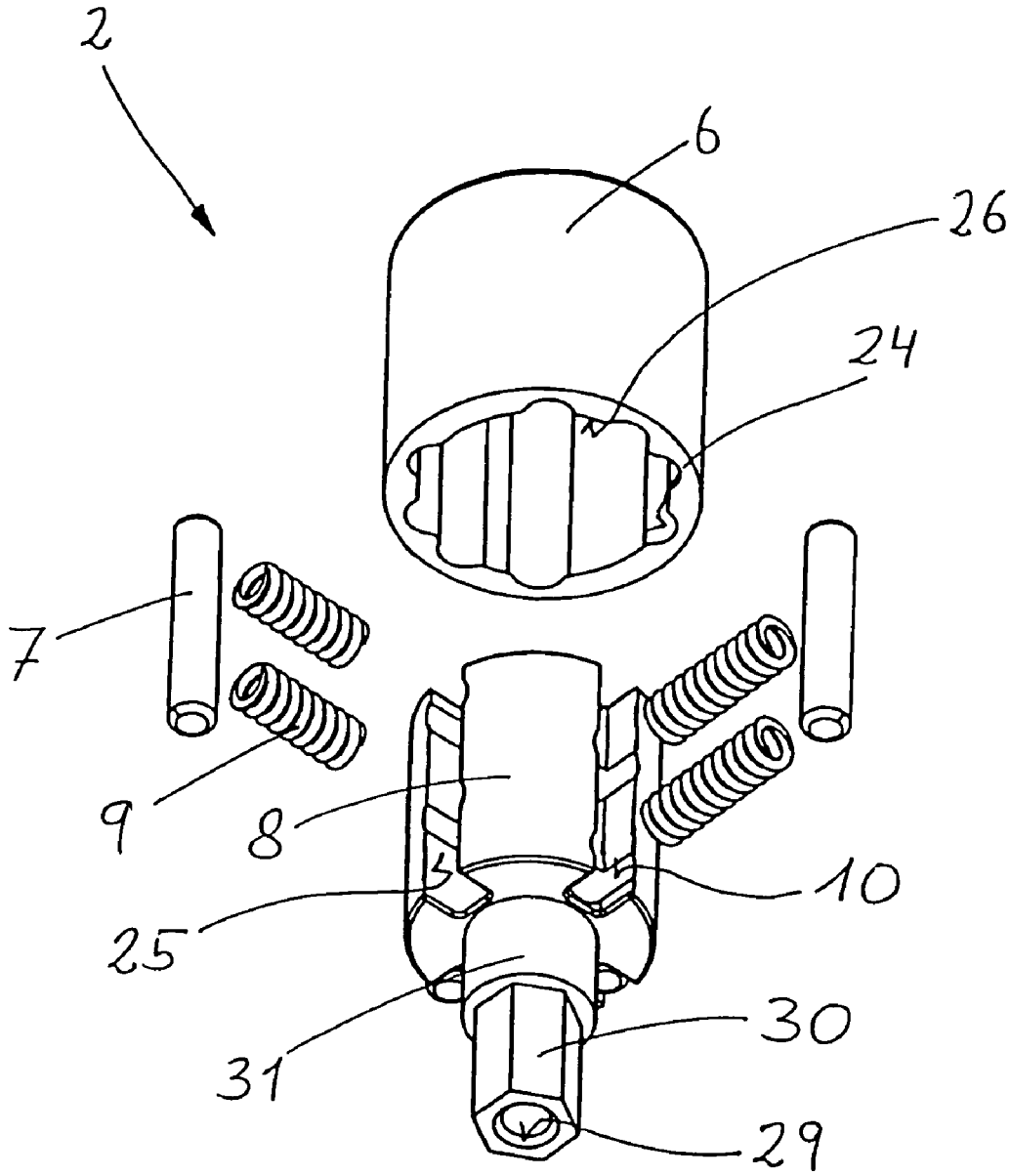
FIG. 5 is an exploded view of the holder of the door hinge in FIG. 4.
Figure 6:
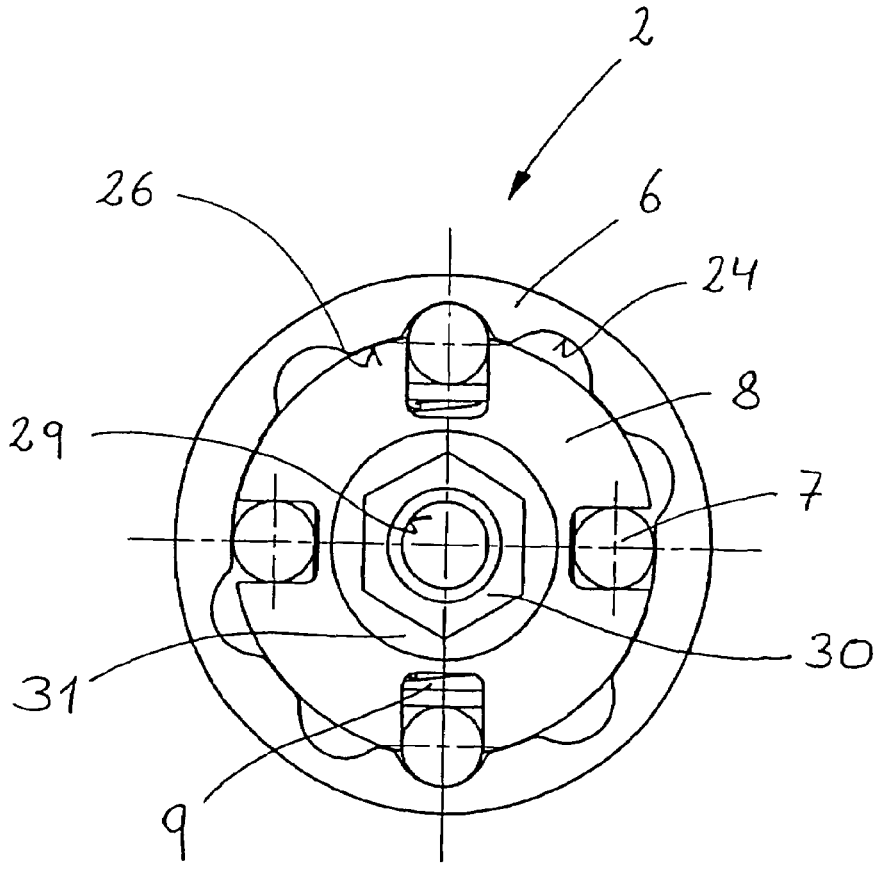
FIG. 6 is a sectional view of the holder of the door hinge in FIG. 4.

In order to hold stop member carrier 8 in place on pillar bracket 4, a screw 18 can be inserted from the side of pillar bracket 4 opposite stop member carrier 8 into a threaded bore 29 of stop member carrier 8 (cf. FIG. 5, FIG. 6). The structure of holder 2' and door hinge 1' is otherwise the same as the structure of holder 2 shown in FIG. 1.

Figure 7:
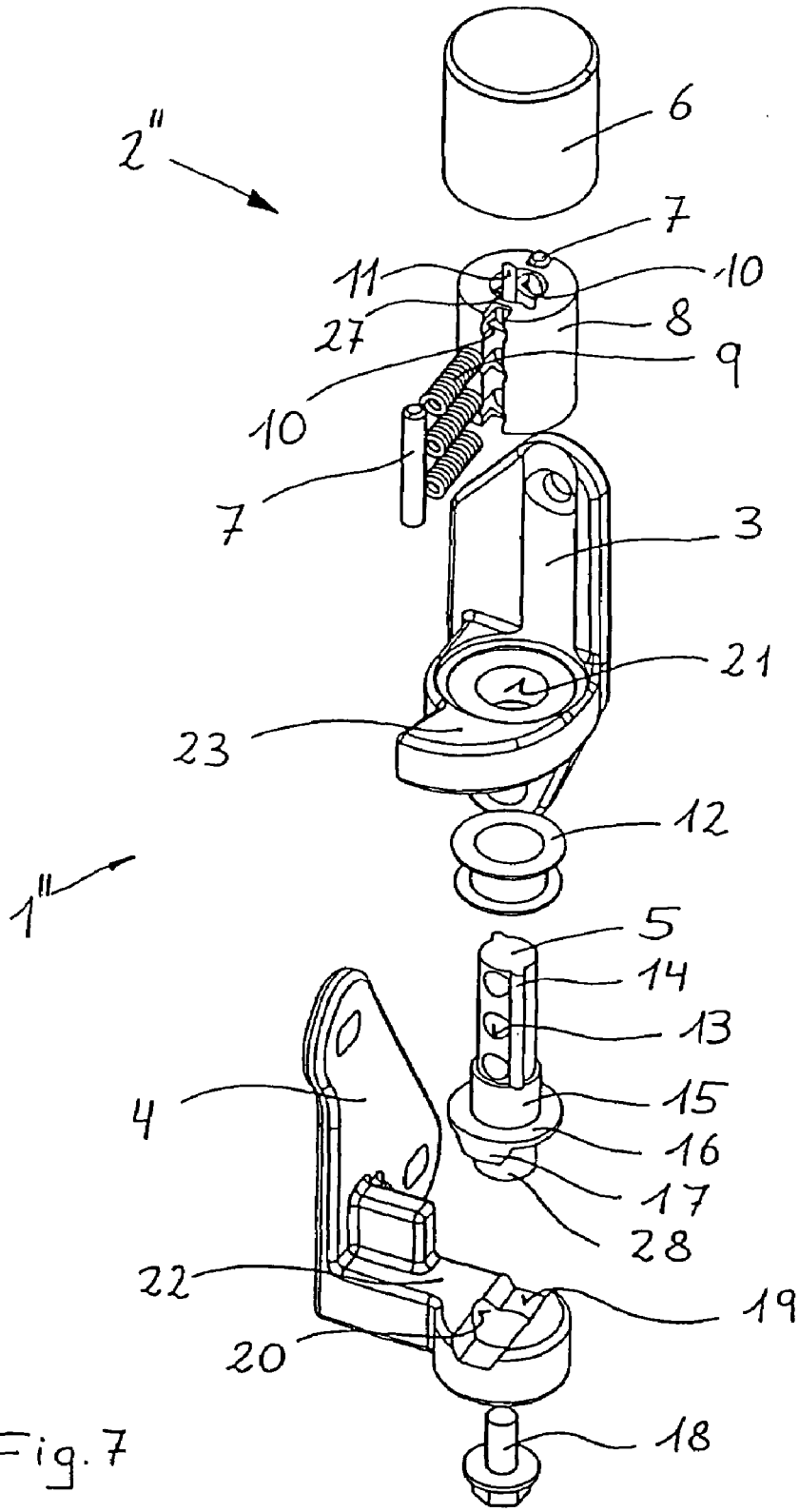
FIG. 7 is an exploded view of another embodiment of a door hinge with two stop members and a hinge pin which can be attached in an anti-rotational manner on the pillar brackets by means of a step.

Another embodiment of door hinge 1" shown in FIG. 7 differs from the embodiment of door hinge 1 shown in FIG. 1 by the different structure of holder 2. Unlike the holder 2 shown in FIG. 1, the present holder 2" only has two pins 7, arranged opposite each other, biased at their ends by three parallel spiral springs 9. Spiral springs 9 extend through corresponding bores 10, 13 in stop member carrier 8 and hinge pin 5.

Stop marks 24 on inside surface 26 of engagement sleeve 6 are positioned such that pins 7 essentially come into synchronous engagement with corresponding stop marks 24. The anti-rotation arrangement of stop member carrier 8 is carried out in the manner mentioned with reference to FIG. 1.

Figure 9:
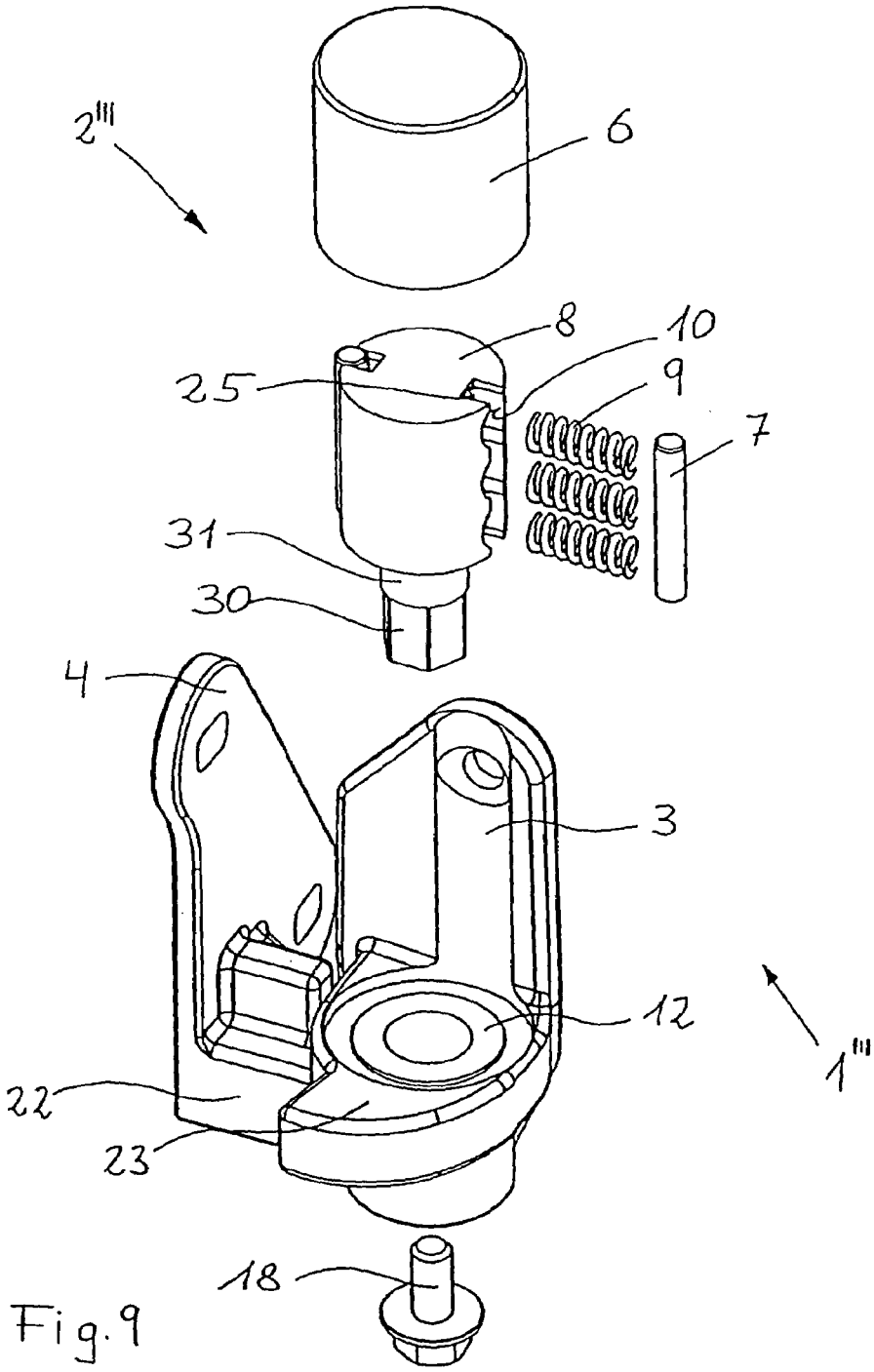
FIG. 9 is an exploded view of another embodiment of the door hinge with a stop member carrier integrally formed with the hinge pin and with two stop members arranged on it.

With the embodiment of door hinge 1''' shown in FIG. 9, stop member carrier 8 is, again, integrally formed with hinge pin 5 and has a shank 31 for the rotatable support of stop member carrier 8 in bearing bush 12 arranged in a through hole 21 of door bracket 3. For the anti-rotation arrangement of stop member carrier 8 at pillar bracket 4, the latter has a hexagonal connection section 30 which can be arranged in a corresponding receiving opening 20' in leg 22 of pillar bracket 4. A screw 18 insertable from the opposite side in threaded bore 29 in connection section 30 secures the position of stop member carrier 8 at door bracket 3 and at pillar bracket 4.

Figure 8:
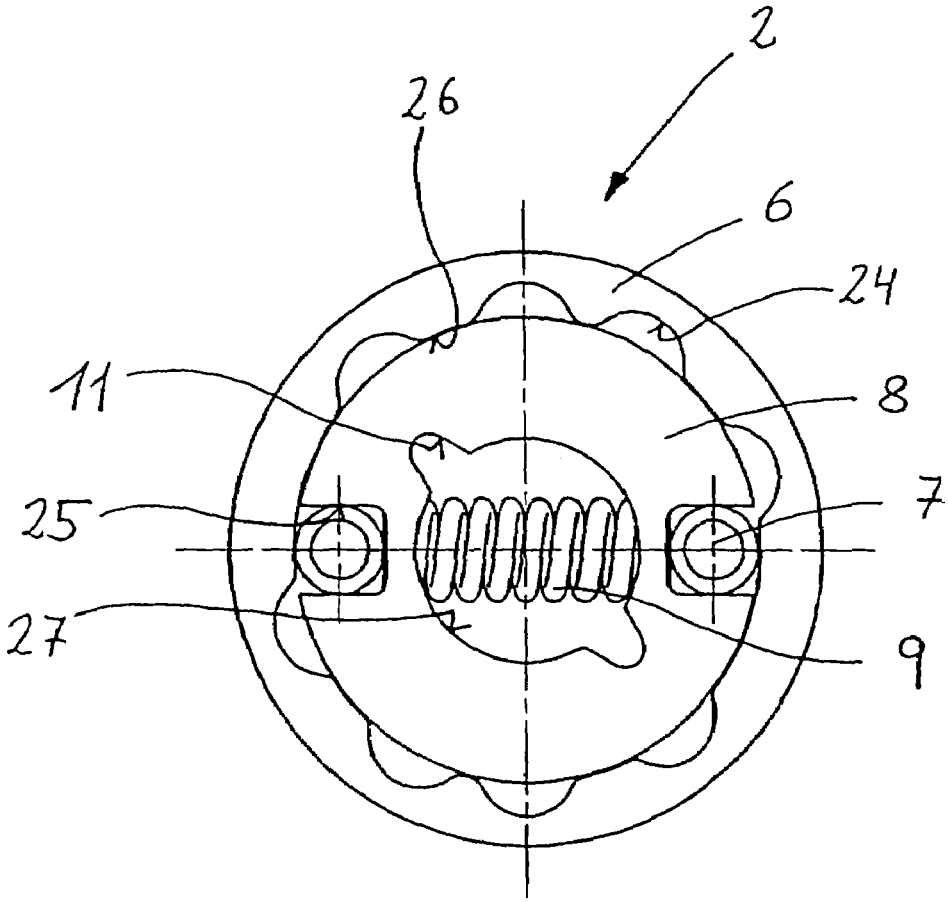
FIG. 8 is a sectional view of the holder of the door hinge of FIG. 7.
Figure 10:
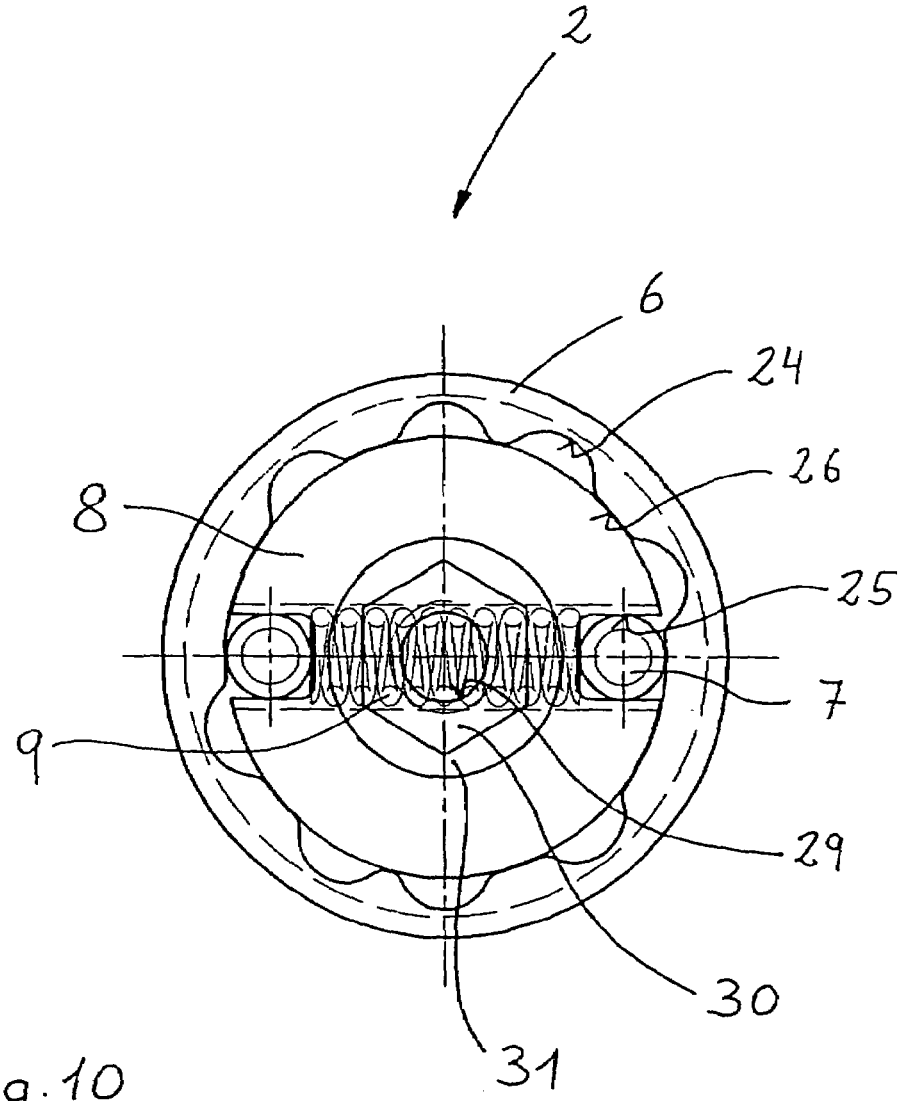
FIG. 10 is a sectional view of the holder of the door hinge of FIG. 9.

The arrangement of stop marks 24 on inside surface 26 of engagement sleeve 6 according to FIG. 10 corresponds to the distribution of stop marks 24 on holder 2 according to FIG. 8.

Figure 11:
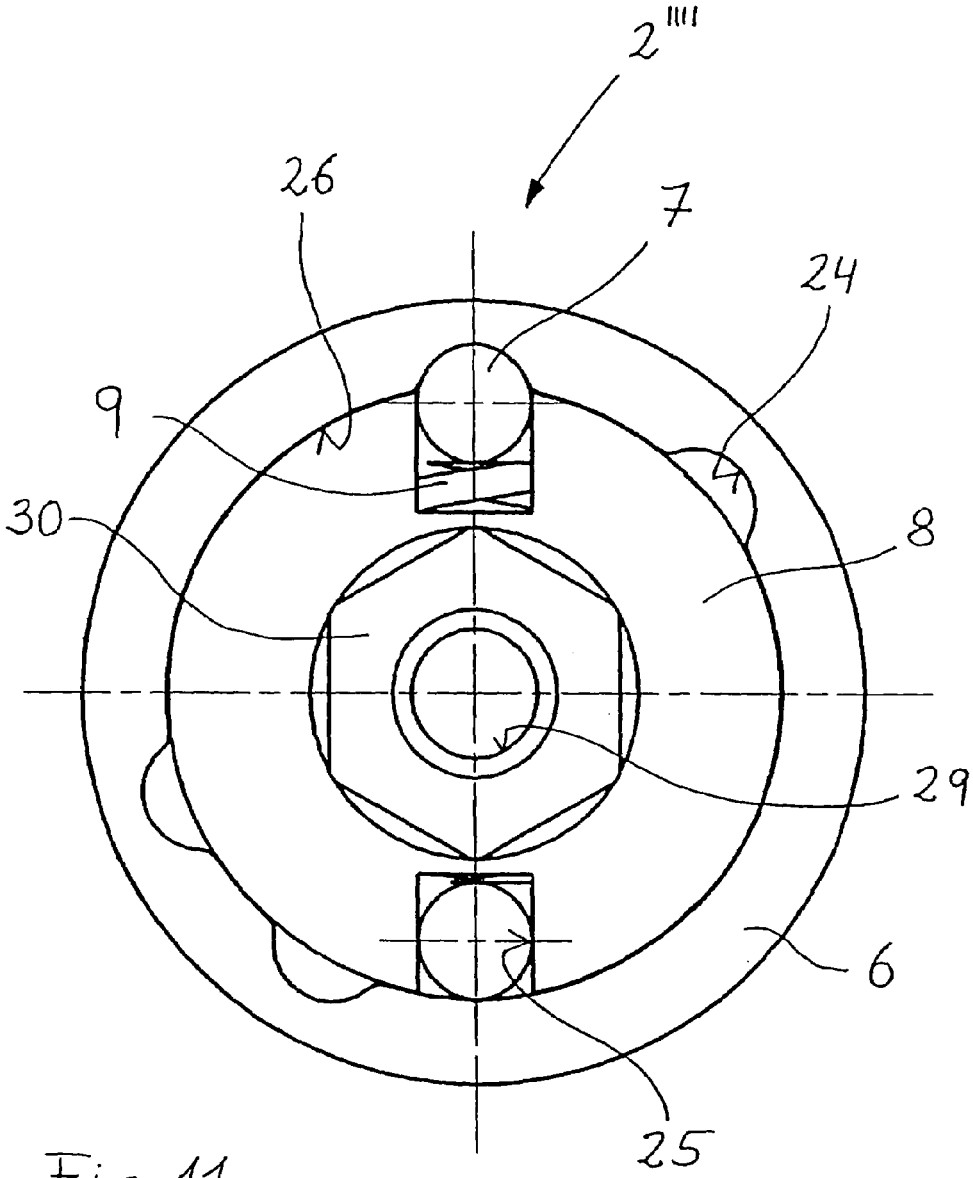
FIG. 11 is a sectional view of another embodiment of a holder of a door hinge (not shown).

In the sectional view of FIG. 11 of another embodiment of a holder 2'''', stop marks 24 are arranged on the inside surface

26 of engagement sleeve 6 in such a way that only one of two opposite pins 7 ever engages corresponding stop marks 24, wherein simultaneously the opposite pin 7 is in an area extending between stop marks 24 of inside surface 26. Thus, by means of four stop marks 24 not opposing each other and two opposing pins 7, a total of four angular positions can be covered in an area of 90°.

The invention claimed is:

1. A door hinge with a holder for motor vehicle doors, wherein the door hinge comprises a pillar bracket attachable at a motor vehicle and a door bracket connectable with the motor vehicle door, the door bracket being pivotably linked to the pillar bracket by a hinge pin arranged in one bracket of said door bracket and said pillar bracket in an anti-rotational manner and rotatably arranged in the other bracket of said door bracket and said pillar bracket, said holder comprising a stop member carrier connected in an anti-rotational manner with said hinge pin and an engagement element supported so as to be rotatable together with the other bracket relative to said stop member carrier, said engagement element having at least one stop mark on a surface facing said stop member carrier, wherein at least two stop members biased by a spring element are arranged on said stop member carrier in such a way that the stop members can be brought into engagement with the surface of said engagement element facing said stop member carrier, wherein said spring element (9) presses at it ends against two neighbouring or opposite stop members (7) arranged on said stop member carrier (8), characterized in that said stop marks (24) are distributed on the surface of the engagement element (6) facing the stop member carrier (8) in such a way that said opposite stop members (7) can be brought into alternate engagement with said associated stop marks (24).

2. The door hinge according to claim 1, characterized in that said spring element (9) extends between opposite stop members (7) through corresponding bores (13) in the hinge pin (5).

3. The door hinge according to claim 1, characterized in that said stop members (7) are biased by at least one other spring element (9) essentially extending parallel to said spring element (9).

4. The door hinge according to claim 1, characterized in that balls or cylindrical pins (7) of a circular diameter are provided as said stop members, which are able to be brought into engagement with the surface facing the stop member carrier configured as an engagement sleeve (6) and having at least one stop mark (24) formed corresponding to said balls or pins (7).

5. The door hinge according to claim 1, characterized in that said stop member carrier (8) has correspondingly formed grooves (25) for guiding said stop members (7) and corresponding bores (10) for guiding said spring element (9).

6. The door hinge according to claim 1, characterized in that one or two pairs of said opposite stop members (7) are provided, which are biased by said spring element (9) contacting said stop members (7) at their ends and extending through corresponding bores (10, 13) in said stop member carrier (8) and said hinge pin (5), and are formed by spiral springs (9).

7. The door hinge according to claim 1, characterized in that said hinge pin (5), at its contacting surface with said stop member carrier (8), has at least one protrusion (14) which can be brought into engagement with a correspondingly formed groove (11) on said stop member carrier (8).

8. The door hinge according to claim 1, characterized in that said hinge pin (5) is integrally formed with said stop member carrier (8).

9. The door hinge according claim 1, characterized in that said stop members (7), said engagement element (6) and/or said stop member carrier (8) are hardened in their contacting areas.

10. The door hinge according to claim 9, wherein said stop members (7), said engagement element (6) and/or said stop member carrier (8) are surface hardened in their contacting areas.

11. The door hinge according to claim 1, wherein said hinge pin and said other bracket define a sliding section (15) for pivot of said other bracket relative to said hinge pin, wherein said hinge pin has a longitudinal axis about which said pivot occurs, and wherein said holder is spaced along said axis from said sliding section.

* * * * *